US005157798A

United States Patent [19]

Van Kammen

[11] Patent Number: 5,157,798

[45] Date of Patent: Oct. 27, 1992

[54] TRANSPARENT EMERGENCY EYE WASH FOUNTAIN

[75] Inventor: Jon A. Van Kammen, Milwaukee, Wis.

[73] Assignee: Bradley Corporation, Menomonee Falls, Wis.

[21] Appl. No.: 604,588

[22] Filed: Oct. 26, 1990

[51] Int. Cl.[5] ..... A61H 33/00

[52] U.S. Cl. ..... 4/620; 137/616.7

[58] Field of Search ..... 4/620, 626, 625, 619

[56] References Cited

U.S. PATENT DOCUMENTS

| | | | |
|---|---|---|---|
| 1,697,229 | 1/1929 | De Motte | 604/260 X |
| 2,999,249 | 9/1961 | Logan et al. | 4/620 X |
| 3,469,603 | 9/1969 | Nagel | 137/616.7 X |
| 3,599,251 | 8/1971 | Wright | 4/620 |
| 4,012,798 | 3/1977 | Liautaud . | |
| 4,363,146 | 12/1982 | Liautaud . | |
| 4,627,845 | 12/1986 | De Motte | 4/620 X |
| 4,675,924 | 6/1987 | Allison et al. | 4/619 X |
| 4,727,906 | 3/1988 | Holzer | 137/616.7 X |
| 4,881,283 | 11/1989 | Liautaud . | |
| 4,939,800 | 7/1990 | Fiorentino et al. | 4/620 |

*Primary Examiner*—Daniel M. Yasich

*Attorney, Agent, or Firm*—Whyte & Hirschboeck

[57] ABSTRACT

A transparent emergency eye wash fountain is provided having a portable unitary housing including a fold down tray carrying spray nozzle means for discharge of an eye wash fluid onto the eyes. The fluid is discharged by folding down the tray to open a valve. A liquid reservoir is positioned above the nozzle means and opening of the valve causes discharge eye wash fluid through the nozzle in a sustained gravitationally fed stream from said reservoir. The housing is formed of a tough, impact resistant transparent injection molded polymer. The injection molded polymer preferably has an optical transmission of at least 45% in accordance with ASTM Method #D-1003, which enables viewing through the wall of the fluid level within the housing as well as the presence of harmful contamination.

7 Claims, 2 Drawing Sheets

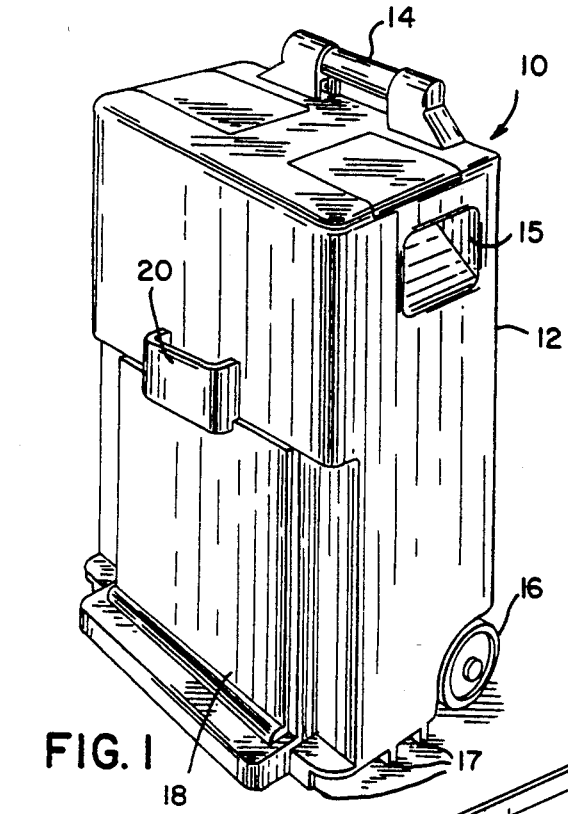
FIG. 1
FIG. 2
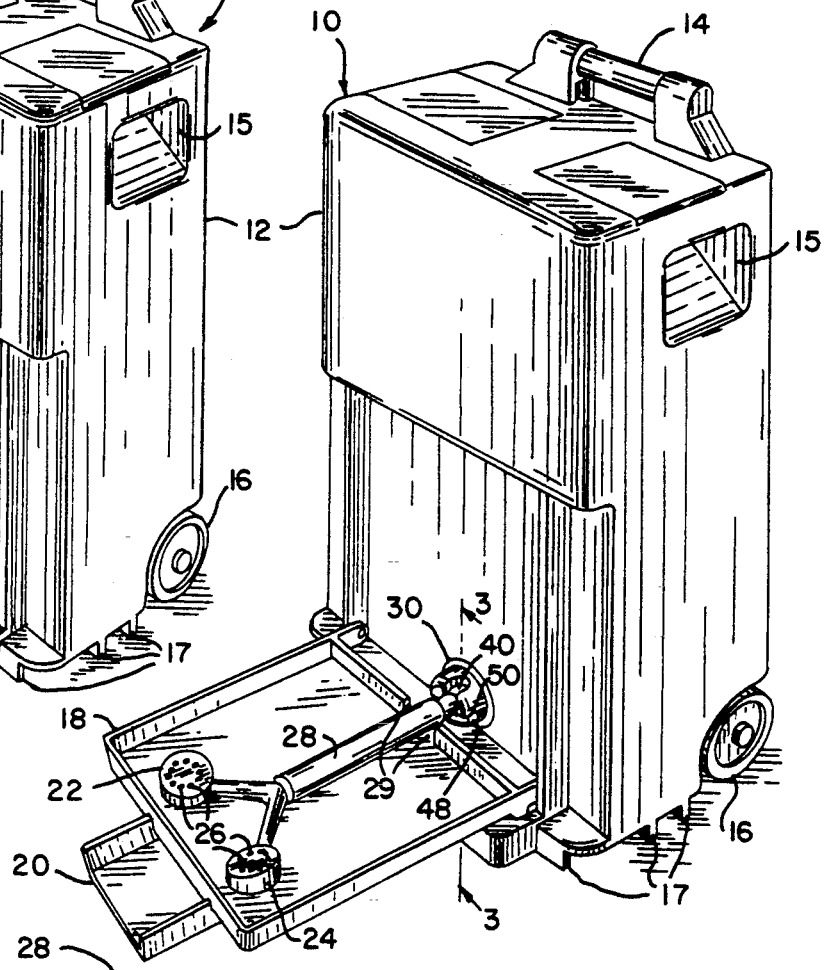
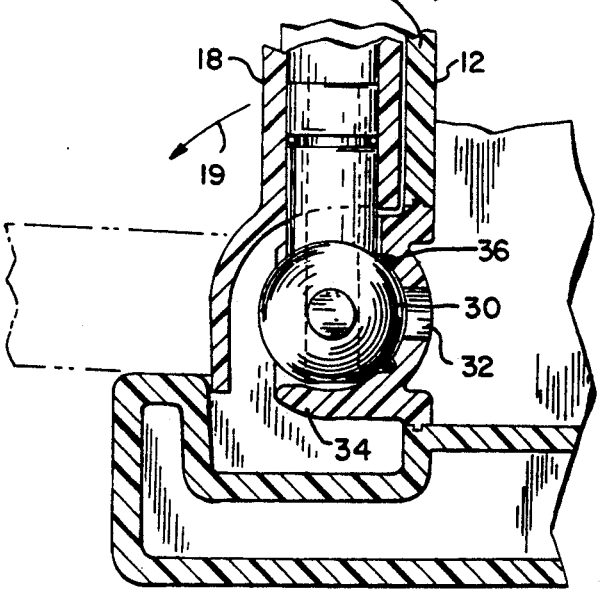
FIG. 3

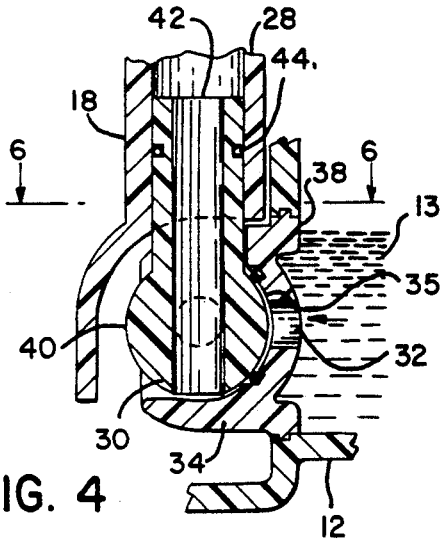
FIG. 4
FIG. 5
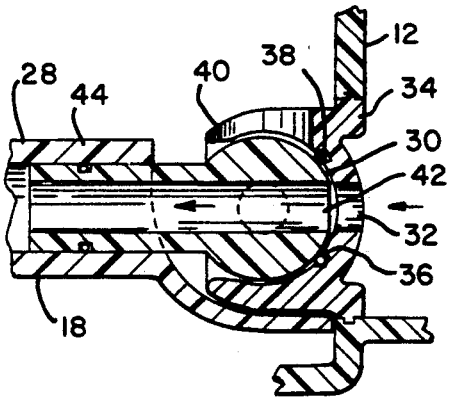
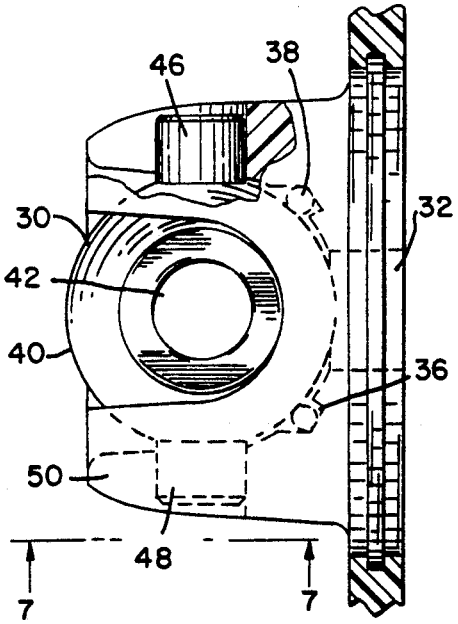
FIG. 6
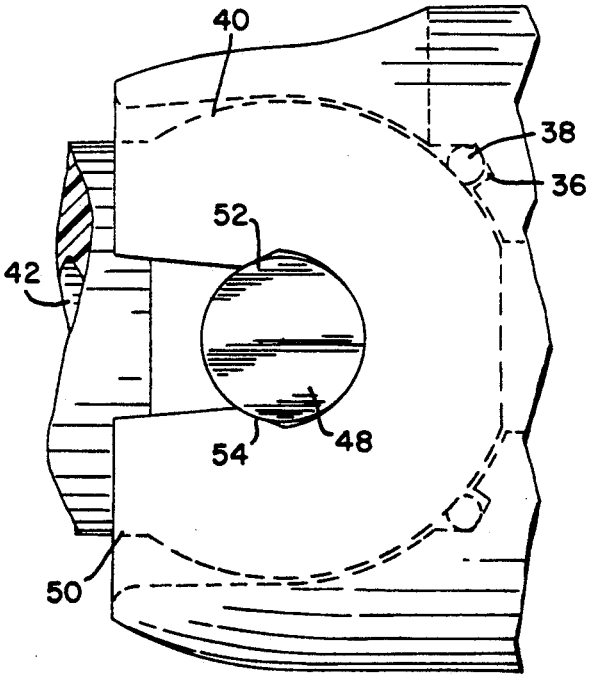
FIG. 7

TRANSPARENT EMERGENCY EYE WASH FOUNTAIN

BACKGROUND OF THE INVENTION

1. Field of the Invention

The present invention relates to emergency eye wash fountains used for flushing foreign materials or irritants from a worker's eyes on an emergency basis at industrial work stations. More particularly, the invention relates to such devices which include an optically transparent housing so that the quantity and condition of the contents can be observed without opening the container. A further aspect of the invention relates to an improved valve arrangement for use in eye wash fountains.

2. Background Art

Various emergency eye wash fountains are provided at industrial locations where workers may be subjected to accidental introduction in their eyes of foreign matter or irritants. Many of such devices operate by providing an elevated reservoir of eye wash liquid which can be made to flow by gravity at a sustained flow rate for at least fifteen (15) minutes. Examples of such devices are shown in U.S. Pat. No. 4,012,798 issued Mar. 22, 1977, U.S. Pat. No. 4,363,146 issued Dec. 14, 1982 and U.S. Pat. No. 4,881,283 issued Nov. 21, 1989, all to John R. Liautaud.

Such devices have heretofore been formed of a plastic material such as polyethylene or polypropylene which is formed into a container by either blow molding or rotational molding. The housings have heretofore been generally opaque or at best translucent, and thus, incorporation of a visible gage of such as float gage has been necessary to indicate whether the supply of liquid in the reservoir is adequate for safety purposes. Although such materials have been obtainable in transparent form for other uses, because of the thickness required for eye wash fountain reservoirs, it has not been possible to produce transparent housings using such materials of construction.

In addition to inability to view the liquid level of the contents it has been found that contamination or microbe growth can on occasion occur within the containers due to the presence of impurities in the water supply, or foreign matter introduced during inspection and the like. Thus, such fountains heretofore available have the added disadvantage of shielding from view the growth of such microbes or presence of other contaminants, which may be harmful to the eyes.

SUMMARY OF THE INVENTION

The emergency eye wash fountains of this invention are formed of a portable unitary housing which includes a fold down spray nozzle means mounted on and supported by a pivotable tray for discharge of an eye wash fluid onto the eyes. A liquid reservoir is positioned above the nozzle means, and a valve is provided which is normally closed when the tray is in the upright position but which can be opened by lowering the tray to discharge eye wash fluid through the nozzles carried by the tray in a sustained gravitationally fed stream from said reservoir. The housing is formed of an optically transparent injection molded polymer having an notched izod impact resistance in accordance with ASTM #D-256 at 23° C. of at least 10, a tensile modulus of at least 300,000 psi in accordance with ASTM Test

#D-638, and a flexural modulus in accordance with ASTM test D-790 of at least 300,000 psi.

DRAWINGS

The invention will be more fully explained with reference to the following detailed description and accompanying drawings wherein:

FIG. 1 is a perspective view of an eye wash fountain unit of the present invention shown in the storage position, FIG. 2 is a perspective view of the eye wash fountain of FIG. 1 showing the unit in a position to discharge eye wash liquid, FIG. 3 is a broken away cross-sectional view showing the fluid discharge valve in a closed position indicating the open position with dotted lines, FIG. 4 is a cross-sectional view showing the valve component of FIG. 3 with the valve parts in cross-section, FIG. 5 is a further cross-sectional view taken along line 3—3 of FIG. 2 showing the valve in open position with all parts in cross-section, FIG. 6 is a broken away view along 6—6 of FIG. 4 with interior parts shown by dotted lines and broken away parts in cross-section, and, FIG. 7 is a side view of the valve taken along line 7—7 of FIG. 6 showing with parts broken away and showing interior components by means of dotted lines.

DETAILED DESCRIPTION

The emergency eye wash fountain 10 of this invention as seen in FIGS. 1 and 2 includes a portable unitary housing 12 for containing eye wash fluid 13. Typically, the emergency eye wash fountain 10 will be constructed in a size large enough to hold a minimum of 6 gallons of fluid. This assures a continuous gravity fed flow of fluid during use for a period of at least 15 minutes. For convenience in transporting the fountain in an industrial plant the housing is provided with a handle 14 at its top, two molded-in sidehandles 15, and wheels 16 at its bottom. Various projections of 17 can be provided on the bottom the housing to assure that the fountain sits in a level position when it is placed for use on a table, counter or other supporting surface at a height so that it may be conveniently used when an emergency occurs.

Attached to the lower portion of the front surface of housing 12 is a pivotable tray 18 which is provided at its upper most end with a handle 20 for pulling tray 18 down from an upright position as shown in FIG. 1 to a lowered position for use as shown in FIG. 2. As seen in FIG. 2, and arrow 19 in FIG. 3, the tray is lowered to a position approximately 90° away from the front of the housing when the fountain is used. Tray 18 carries a pair of spray nozzles 22 and 24 which are provided with apertures 26 for discharge of eye wash fluid. As seen, the spray nozzles 22 and 24 are sloped inwardly and spaced apart at a distance such that two streams of fluid will be discharged toward each other spaced apart so that both eyes can be simultaneously washed by the fluid. The tray also carries appropriate conduit 28 to convey the eyewash fluid 13 from housing 12 to the nozzles 22 and 24.

Conduit 28 is connected to a valve 30 which is arranged so that the valve is closed when the tray is in the upright position shown in FIG. 1 but the valve is open and fluid is discharged when the tray is lowered to the position shown in FIG. 2.

As best seen in FIGS. 3 and 5, the lower forward panel of housing 12 is provided with an opening 32 which in the preferred embodiment illustrated in the drawings is positioned at the center of an insert 34 which contains a hemispherical depression surrounding opening 32. Instead of an insert 32, the hemispherical depression can also be molded directly into the housing 12. As seen in the drawings, insert 34 is bonded in place in housing 12 utilizing a tongue and groove bond joint configuration. However, other sealing configurations can be substituted, as will be appreciated by those skilled in the art. Near the extremity of the hemispherical depression 35 is a circular groove 36 which is adapted to receive an O-ring 38 or similar, preferably elastomeric sealing member. In the preferred embodiment the bottom end of valve 30 is formed of a spherical or ball-shaped enlargement 40 of a diameter such that it will fit into depression 35 and sealingly engage O-ring 38 and to close opening 32. The open bore 42 of the valve 30 is thus seen, as shown in FIG. 5, to be in alignment with opening 32 when the tray is pivoted downwardly to permit fluid 13 to flow through opening 32. Additional O-rings or similar seals 44 are provided to prevent leakage at the point of engagement of the stem of valve 30 with conduit 28. As seen in FIGS. 6 and 7 the preferred embodiment of the valve is provided with cylindrical extensions 46 and 48 integral with the ball portion 40 of valve 30. In the preferred embodiment the valve is held in an assembled position by snapping extensions 46 and 48 into a slot in a C-shaped mounting element 50 which is integral with the face of housing 12. Cylindrical extensions 46 and 48 are thus pivotably engaged in C-shapes slots 50, each of which is provided on its interior surface with shoulders 52 and 54 to provide pressure on the ball valve toward opening 32.

While a ball valve configuration has been shown as a preferred embodiment it will be apparent to those skilled in the art that other known rotatable valve arrangements can be substituted if desired.

As noted, an important feature of the present invention is the optically transparent nature of the housing 12. "Optically transparent" as the term is used herein is intended to refer to materials that provide an optical transmission rate of at least 45 percent in accordance with ASTM test method Number D-1003, provided further that the light is not diffused, so that an optical clarity is provided sufficient to permit a page of 12 point typewriter type to be legible through the walls of a container with a distance between the printed page held against the exposed outer surface of one wall through the thickness of that wall, through the interior of housing 12 and through the wall thickness of the oppositely disposed wall of up to 10 inches (25.4 cm). This characteristic is achieved by injection molding a medical grade polymer into a suitably shaped mold.

The preferred polymer for this purpose is a polyvinyl chloride marketed under the designation Geon $R_X$ Medical Grade Compound No. 87402. This material has the necessary characteristics of producing a injection molded object with an optical transmission rate of 58%, while being non-toxic. This material also meets the further criteria having a notched izod impact resistance in accordance with ASTM Test #D-256 at 23° C. of at least 10, a tensile modulus of at least 300,000 psi in accordance with ASTM Test #D-638 and a flexural modulus in accordance with ASTM Test #D-790 of at least 300,000 psi. Other materials having these properties provided that they are optically clear and can be injection molded can be substituted. Examples of suitable materials are medical grade silicone elastomers, polyurethanes, acrylics, polycarbonates, polyimides and co-polymers thereof. However at the present time the aforementioned polyvinyl chloride compounds are preferred in terms of their superior properties and economy.

Any suitable injection molding equipment can be employed provided that smooth mold surfaces should be provided in order to achieve good optical clarity in the resultant molded materials. The molding temperature will be determined by the softening temperature of the polymer and its flow characteristics at various temperatures. While some latitude based on the physical characteristics of the specific polymer employed, it is preferred that the walls 12 of the reservoir be approximately 5 millimeters in thickness.

In operation, the eye wash fountains of this invention are placed on a stand, table or counter of suitable elevation for use in an emergency. The quantity of fluid can be visually monitored as well as the presence of any contaminants such as growth of any microorganisms within the container. Two steady gravitationally fed streams are provided by lowering of tray 18 to open valve 30. Openings 29 are provided in the frame work of tray 18 to avoid pooling up of fluid around nozzles 22 and 24.

What is claimed is:

1. In an emergency, transparent eye wash fountain comprising a portable unitary housing having a bottom, a top and front and rear sidewalls for containing eye wash fluid, said housing carrying spray nozzle means supported by the front sidewall for discharge of an eye wash fluid onto the eyes, a liquid reservoir communicating with the nozzle means, and valve means communicating with said liquid reservoir and with said nozzle means, said valve means being normally closed but which can be opened to discharge said eye wash fluid from said fluid reservoir through said nozzle means in a sustained gravitationally fed stream from said reservoir, wherein the improvement comprises at least a sidewall of said housing being formed of an injection molded medical grade polymer having an optical transmission of at least 45% in accordance with ASTM method D-1003, a notched izod impact resistance in accordance with ASTM #D-256 at 23° C. of at least 10, a tensile modulus of at least 300,000 psi in accordance with ASTM Test #D-638, and a flexural modulus in accordance with ASTM test D-790 of at least 300,000 psi.

2. In the emergency eye wash fountain according to claim 1, wherein the improvement further comprises the said sidewall to be of medical grade polymer having an optical transmission rate of 58% and optical clearity sufficient to permit a page of 12 pt. typewriter type to be legible through the sidewalls of said housing with a distance of up to 10 inches measured between a printed page held against the exposed outer surface of one sidewall, through that sidewall thickness, the interior of said housing and through the oppositely disposed sidewall thickness.

3. In the emergency eye wash fountain according to claim 1, wherein the improvement includes said polymer to be of an injection molded medical grade polyvinyl chloride.

4. An upstanding emergency eye wash fountain comprising a portable unitary housing having a bottom, a top, and front and rear sidewalls for containing eye wash fluid, said unitary housing having an aperture in the front sidewall located adjacent to the said bottom, a tray pivotably supported by the front sidewall and normally disposed in a closed upright position relative to said front sidewall, with the pivot axis of said tray being located below the said aperture, said tray carrying a pair of spray nozzles for discharge of said eye wash fluid into the eyes, said tray further carrying valve means communicating with the said spray nozzles and arranged to control discharge of fluid from said front sidewall aperture, which valve means is in a closed valve operating position when said tray is pivotably disposed in an upright position and which valve means is opened by pivotably lowering said tray to valve open position approximately 90° relative to the front sidewall of said housing in which valve open position said valve means permits discharge of said eye wash fluid from said housing through said front sidewall aperture and through said spray nozzles.

5. An emergency eye wash fountain according to claim 4 wherein said housing is formed from an impact resistance injection molded polymer.

6. An emergency eye wash fountain according to claim 5 wherein said polymer comprises polyvinyl chloride.

7. An emergency eye wash fountain according to claim 4, wherein the said valve means comprises a ball valve and the front sidewall of said housing contains a hemispherical depression surrounding said aperture in said front sidewall and said ball valve has a diameter adapted to fit in said depression, said depression being provided with a seal around said aperture, said ball valve having an opening extending through the diameter thereof which is out of communication with said aperture in said front sidewall when the tray is in an upright position but which ball valve opening becomes aligned with said aperture when said tray is pivotably lowered to a fluid discharge position.

* * * * *

UNITED STATES PATENT AND TRADEMARK OFFICE

CERTIFICATE OF CORRECTION

PATENT NO. : 5,157,798

DATED : October 27, 1992

INVENTOR(S) : See Below

It is certified that error appears in the above—identified patent and that said Letters Patent is hereby corrected as shown below:

On the title page, Item [75] indicates " Jon A. Van Kammen as a sole inventor. Multiple inventors should have been listed; namely Thomas G. Barnum of Fox Point, Wisconsin; John M. Gagas of Milwaukee, Wisconsin and Jon A. Van Kammen of Milwaukee, Wisconsin.

Signed and Sealed this

Fifth Day of October, 1993

*Attest:*

*Attesting Officer*

BRUCE LEHMAN

*Commissioner of Patents and Trademarks*